US007081152B2

(12) United States Patent
Altman et al.

(10) Patent No.: US 7,081,152 B2
(45) Date of Patent: Jul. 25, 2006

(54) ESP PERFORMANCE OPTIMIZATION CONTROL

(75) Inventors: Ralph F. Altman, Chattanooga, TN (US); Robert N. Guenther, Bordentown, NJ (US)

(73) Assignee: Electric Power Research Institute Incorporated, Palo Alto, CA (US)

( * ) Notice: Subject to any disclaimer, the term of this patent is extended or adjusted under 35 U.S.C. 154(b) by 200 days.

(21) Appl. No.: 10/780,811

(22) Filed: Feb. 18, 2004

(65) Prior Publication Data

US 2005/0178265 A1 Aug. 18, 2005

(51) Int. Cl.
*B03C 3/68* (2006.01)

(52) U.S. Cl. ..... 95/5; 95/7; 95/81; 96/20; 96/24; 96/25; 96/80; 323/903

(58) Field of Classification Search ..... 95/5–7, 95/80, 81; 96/20–25, 80–82; 323/903
See application file for complete search history.

(56) References Cited

U.S. PATENT DOCUMENTS

| | | | | | |
|---|---|---|---|---|---|
| 1,959,374 | A | * | 5/1934 | Lissman | 95/81 |
| 2,666,496 | A | * | 1/1954 | Willison | 95/5 |
| 3,048,955 | A | * | 8/1962 | Little | 95/6 |
| 3,443,358 | A | * | 5/1969 | Drenning et al. | 95/5 |
| 3,577,708 | A | * | 5/1971 | Drenning et al. | 95/5 |
| 3,984,215 | A | * | 10/1976 | Zucker | 95/81 |
| 4,311,491 | A | * | 1/1982 | Bibbo et al. | 95/7 |
| 4,354,860 | A | * | 10/1982 | Herklotz et al. | 95/6 |
| 4,382,805 | A | * | 5/1983 | Herklotz et al. | 95/7 |
| 4,626,261 | A | * | 12/1986 | Jorgensen | 95/6 |
| 4,659,342 | A | * | 4/1987 | Lind | 95/5 |
| 4,690,694 | A | * | 9/1987 | Alig et al. | 95/3 |
| 4,772,998 | A | * | 9/1988 | Guenther et al. | 363/128 |
| 4,936,876 | A | * | 6/1990 | Reyes | 95/6 |
| 5,217,504 | A | * | 6/1993 | Johansson | 95/7 |
| 5,311,420 | A | * | 5/1994 | Zarfoss et al. | 700/28 |
| 5,401,299 | A | * | 3/1995 | Kroeger et al. | 96/23 |
| 5,471,377 | A | * | 11/1995 | Donig et al. | 95/5 |
| 5,542,967 | A | * | 8/1996 | Ponizovsky et al. | 96/82 |
| 5,575,836 | A | * | 11/1996 | Sugiura et al. | 96/82 |
| 5,601,633 | A | * | 2/1997 | Ponizovsky et al. | 95/81 |
| 5,639,294 | A | * | 6/1997 | Ranstad | 95/6 |

(Continued)

FOREIGN PATENT DOCUMENTS

| | | | | |
|---|---|---|---|---|
| JP | 6-47314 | * | 2/1994 | 95/7 |

*Primary Examiner*—Richard L. Chiesa
(74) *Attorney, Agent, or Firm*—Armstrong, Kratz, Quintos, Hanson & Brooks, LLP

(57) ABSTRACT

A gas separation apparatus which uses electrostatic precipitators and a DC power supply is controlled to optimally remove moderate to high resistivity ash. The DC power supply is pulse width modulated to maximize the product of the peak electric field and the average electric field. The method used to optimize operation includes selecting initial on and off times for the power supply, operating the power supply using the initial off and on times, and progressively decreasing the off time. A determination is made whether the off time may be further decreased. Ultimately, the on and off time intervals that produce the highest peak and average voltage are determined, and the system is operated using these parameters. A procedure may be periodically repeated to monitor the process and detect if there has been a change in the system that would require new time intervals. The novel separation apparatus and control method offer particular synergy when applied to the effluent stream from a coal-fired electric power plant or other similar gas streams.

13 Claims, 4 Drawing Sheets

U.S. PATENT DOCUMENTS 5,707,422 A * 1/1998 Jacobsson et al. ..... 95/6
6,224,653 B1 * 5/2001 Shvedchikov et al. ..... 95/58
6,611,440 B1 * 8/2003 Johnston et al. ..... 363/44
2001/0011499 A1 * 8/2001 Reyes ..... 95/7

* cited by examiner

ESP PERFORMANCE OPTIMIZATION CONTROL

BACKGROUND OF THE INVENTION

1. Field of the Invention

This invention pertains generally to gas separation processes. More specifically, the present invention uses voltage sensing techniques to optimize performance of an electrostatic precipitator. In a most specific manifestation, a novel method is provided which maximizes the product of the electric field at the collector plate and the charge of the particles being collected.

2. Description of Related Art

Industries as diverse as mills, pharmaceutical or chemical, food processing, and cement kilns must separate contaminants or particulates from an air or gaseous stream. The gases may be a product of combustion, such as present in an exhaust stack, but may also represent other gas streams and may contain such diverse materials as liquid particulates, smoke or dust from various sources, and the like. Separators that must process relatively large volumes of gas are common in power generating facilities and factories.

The techniques used for purification of gas streams have been diverse, including such techniques as filtration, washing, flocculation, centrifugation, and electrostatic precipitation. Each technique has heretofore been associated with certain advantages and disadvantages. These features and limitations have dictated application.

Electrostatic precipitators have demonstrated exceptional benefit for contaminants including fly ash, while avoiding the limitations of other processes. For example, unlike centrifugation, electrostatic precipitators tend to be highly effective at removing particulates of very minute size from a gas stream. Unlike filtration, the process provides little if any flow restriction, and yet substantial quantities of contaminants may be removed from the gas stream.

When contaminants pass through an electrostatic precipitator, they first pass near precipitator electrodes, which transfer an electrostatic charge to the contaminants. Once charged, the contaminants will be directed by electrostatic force towards oppositely charged collecting electrodes. The collecting electrodes are frequently in the form of plates having large surface area and relatively small gap between collector plates. The dimensions of the plates and the inter-electrode spacing is a function of the composition of the gas stream, electrode potential, particulate size of contaminants, anticipated gas breakdown potential, and similar known factors. The selection of dimension and voltage will be made with the goal of gas stream purification in mind, and in gas streams where very fine particulate matter is to be removed, such as with fly ash, relatively high voltage potentials and larger plates may be provided. The proper transfer of charge to the particulates and the subsequent electrostatic attraction to collector plates is vital for proper operation.

Unfortunately, as the particulates precipitate onto the collector plates, a precipitate layer accumulates and increases in thickness. In the situation in which the particulate matter comprises high resistivity material, the large voltage drop across the high resistivity precipitate layer reduces the voltage differential between the cathode wires and the surface of the precipitate layer, in turn reducing particulate charging and collection. Moreover, the precipitate layer has the characteristics of both resistance and capacitance. When a high electric field gradient is created within the precipitate layer, this may lead to a back-corona discharge or sparking. High resistivity precipitate layers can exhibit back-corona phenomena in which ions are actually emitted from the precipitate layer toward the cathode wires, thereby additionally reducing particle charging and collection. Even though the precipitate layer may be periodically removed by means of rapping or the like, there is still an efficiency reduction concomitant with the formation of this highly-resistive layer.

A problem remains in the powering of electrostatic precipitators to provide control of the precipitator to prevent back-corona or sparking voltages, while at the same time maintaining peak particulate collection efficiency. Accordingly, efficient but yet effective and economical ways of energizing precipitators are highly desirable, particularly for the collection of particulates exhibiting medium to high resistivity. Such dusts are, for example, created in the burning of low sulfur coal used by the electric utility industry.

Newer designs for electrostatic precipitator power supplies operate at frequencies between 1500 and 30,000 Hertz and produce a nearly pure DC voltage and current input to the electrostatic precipitator. This method of energization improves the performance of a precipitator collecting low resistivity particulate such as may be produced from a high-sulfur coal fired utility or the particulate and mist encountered in a wet electrostatic precipitator. However, for the moderate to high resistivity applications identified herein above, such as in low-sulfur coal fired utilities, pure DC energization is not always optimal. In the industry, power supplies that are capable of intermittent energization are adjusted using a trial and error method that uses a secondary electrostatic precipitator performance indicator such as opacity of the gas stream as the measure of performance. These procedures do not necessarily produce a true state of optimum performance because opacity is not a definitive or sensitive measure of the performance of an individual electric field. What is desired then is a method or apparatus to overcome these limitations of the present electrostatic precipitator power supplies when applied to moderate to high resistivity particulate.

BRIEF SUMMARY OF THE INVENTION

The present invention overcomes the limitations of the prior art by using readily available electronic components in a novel operational method which optimizes the performance of an electrostatic precipitator. ESP performance is optimized by rapidly turning off and then turning on the high voltage applied to the ESP to maximize the product of the peak voltage and average voltage. This combination maximizes the product of two critical factors which dictate collection efficiency of an ESP, including the charge on particulates and the electric field at the collection plates. For the bulk of particulates collected in fly ash precipitators, particle charge is proportional to the peak electric field that the particles experience, and the motive force driving the particles to the collection surface at the plate is proportional to the product of the average electric field at the plate and the change on the particles.

In a first manifestation, the invention is a method of applying electrical energy to an electrostatic precipitator collector. The method optimizes precipitation of high resistivity particulates from a gas stream. According to the method, an initial time interval is selected for both the application of electrical energy having a first electrical polarity to the electrostatic precipitator collector and also an initial time interval for interrupting the application of electrical energy. Optimum amounts of time are determined for the application of electrical energy and interrupting of application based upon the greatest of the product peak voltage magnitude applied and greatest average voltage magnitude applied. Precipitate is then collected on the electrostatic precipitator collector using the optimum times for application of electrical energy and interrupting of application.

In a second manifestation, the invention is an electrostatic precipitator performance optimization control method. The method optimizes the performance of an electrostatic precipitator using a high frequency direct current power supply and processing moderate to high resistivity particulate gas streams such as are produced during the combustion of low-sulfur coal in electric utility plants. According to the method, an initial on time interval for applying energy from the high frequency direct current power supply to electrostatic precipitator is established that is comparable to an amount of time required for the electrostatic precipitator to charge from an onset of corona to a spark. An initial off time interval is determined for disconnecting energy from high frequency direct current power supply to electrostatic precipitator which is comparable to an amount of time required for the electrostatic precipitator to discharge from spark potential to a potential consistent with an onset of corona. An active off time interval is specified which is a fraction of the initial off time interval, and an active on time interval is assigned which is a fraction of the initial on time interval. The electrostatic precipitator is alternately energized for the active on time interval and de-energized for the active off time interval. The active off time interval is decreased during each subsequent active on time energizing interval. Peak and average values of an electrical potential attained at the electrostatic precipitator are stored. The active off time interval is then decreased, and the steps of alternately energizing and storing are repeated. The active on time interval and active off time interval are then set to the combination that produced the maximum in the product of the peak times average values of the electrical potential attained at the electrostatic precipitator; and the electrostatic precipitator is operated by alternately energizing for the active on time interval and de-energizing for the active off time interval.

In a third manifestation, the invention applies to an electrostatic precipitator having at least one discharge electrode for charging high resistivity particulates within a gas stream, at least one collector for attracting charged particulates within the gas stream, a high voltage power source operatively and selectively able to apply a high voltage potential of a first polarity between the at least one discharge electrode and the at least one collector, and a means for operatively switching high voltage potential into and out of electrical conduction to the at least one discharge electrode and the at least one collector. The novel improvement to the aforementioned electrostatic precipitator comprises a means for approximating a maximum product of the peak voltage times average voltage applied to the at least one discharge electrode and the at least one collector when a duty cycle of the switching means is varied; a means for storing a duty cycle associated with the maximum; and a means for controlling the switching means to reproduce the stored duty cycle repetitively.

The present invention finds particular utility in a coal-fired electric utility plant discharging fly ash into the atmosphere, wherein a gas separation apparatus optimally removes the fly ash from the plant. This apparatus comprises, in combination, an electrostatic precipitator (ESP) and power supply for the ESP, wherein the power supply has a pulse width modulated to maximize the product of the peak electric field times the average electric field.

Viewed in another aspect, the present invention constitutes a method of optimally operating an electrostatic precipitator in a gas separation apparatus. This method includes the steps of providing an electrostatic precipitator (ESP) powered by a DC power supply, modulating the pulse width of the DC power supply to maximize the product of the peak electric field times the average electric field of the ESP, selecting initial "on" and "off" times, respectively, for the DC power supply, operating the DC power supply using a fraction of the initial "off" time and a fraction of the initial "on" time, and progressively decreasing the "off" time.

OBJECTS OF THE INVENTION

A first object of the invention is to improve the operational effectiveness of electrostatic precipitator systems. A second object of the invention is to more precisely control the operation of an electrostatic precipitator using the principles of electrostatic precipitator operation and the capabilities of new power supplies to produce a true state of optimum performance. A third object of the invention is to periodically monitor the electrostatic precipitator for variations in performance that require adjustment or modification of the control settings. Another object of the invention is to accomplish the foregoing using readily available electronic components. Yet another object of the invention is to facilitate better collection of fly ash from coal-fueled electric utility plants. These and other objects are achieved in the present invention, which may be best understood by the following detailed description and drawings of the preferred embodiment.

DESCRIPTION OF THE PREFERRED EMBODIMENT

Figure 1:
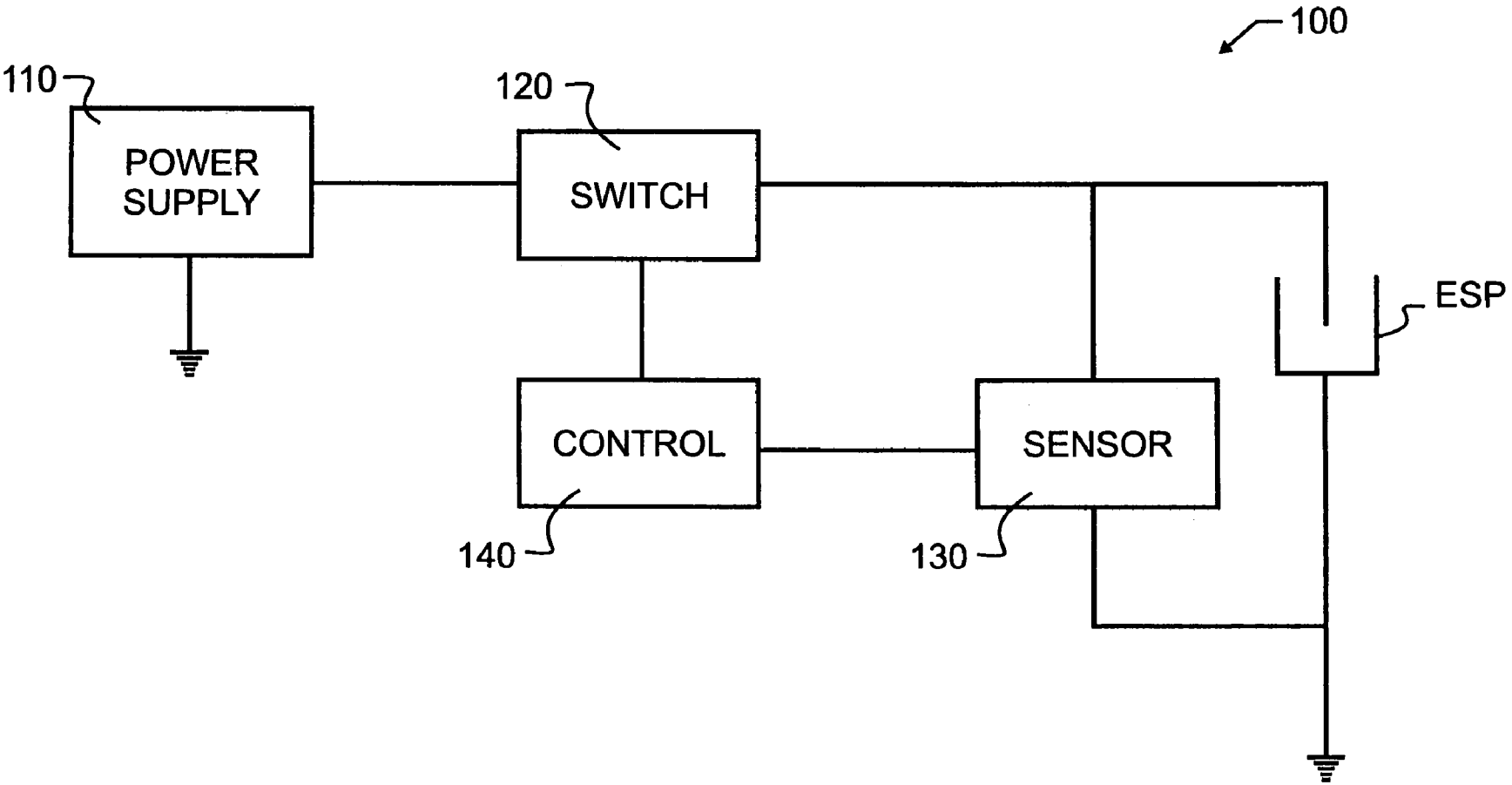
FIG. 1 illustrates a preferred electrical circuit designed in accord with the teachings of the invention by simplified schematic diagram.

With reference to FIG. 1, a preferred electrostatic power supply circuit 100 includes a power supply 110, which, in the most preferred embodiment is a high frequency supply capable of providing nearly pure DC voltage and current. While the features of the invention are applicable to other types of power supplies and may therefore be adapted by those skilled in the art, the greatest predictability and synergy are obtained when applied to high frequency DC supplies. Power supply 110 will be controlled through switch 120 to either apply power to electrostatic precipitator ESP or be disconnected therefrom. Preferably, switch 120 is an integral part of the power supply 110. A sensor 130 is provided which in the preferred embodiment circuit 100 measures the potential between precipitator electrodes and collector plates within ESP. The output of sensor 130 is delivered to control 140. Either within sensor 130 or control 140, means are provided for discerning both the peak voltage across electrostatic precipitator ESP and also the average voltage. These values, VPEAK and VAVE, respectively, are then used by control 140 in association with method 200 of FIG. 2 to control the operation of switch 120.

Figure 2:
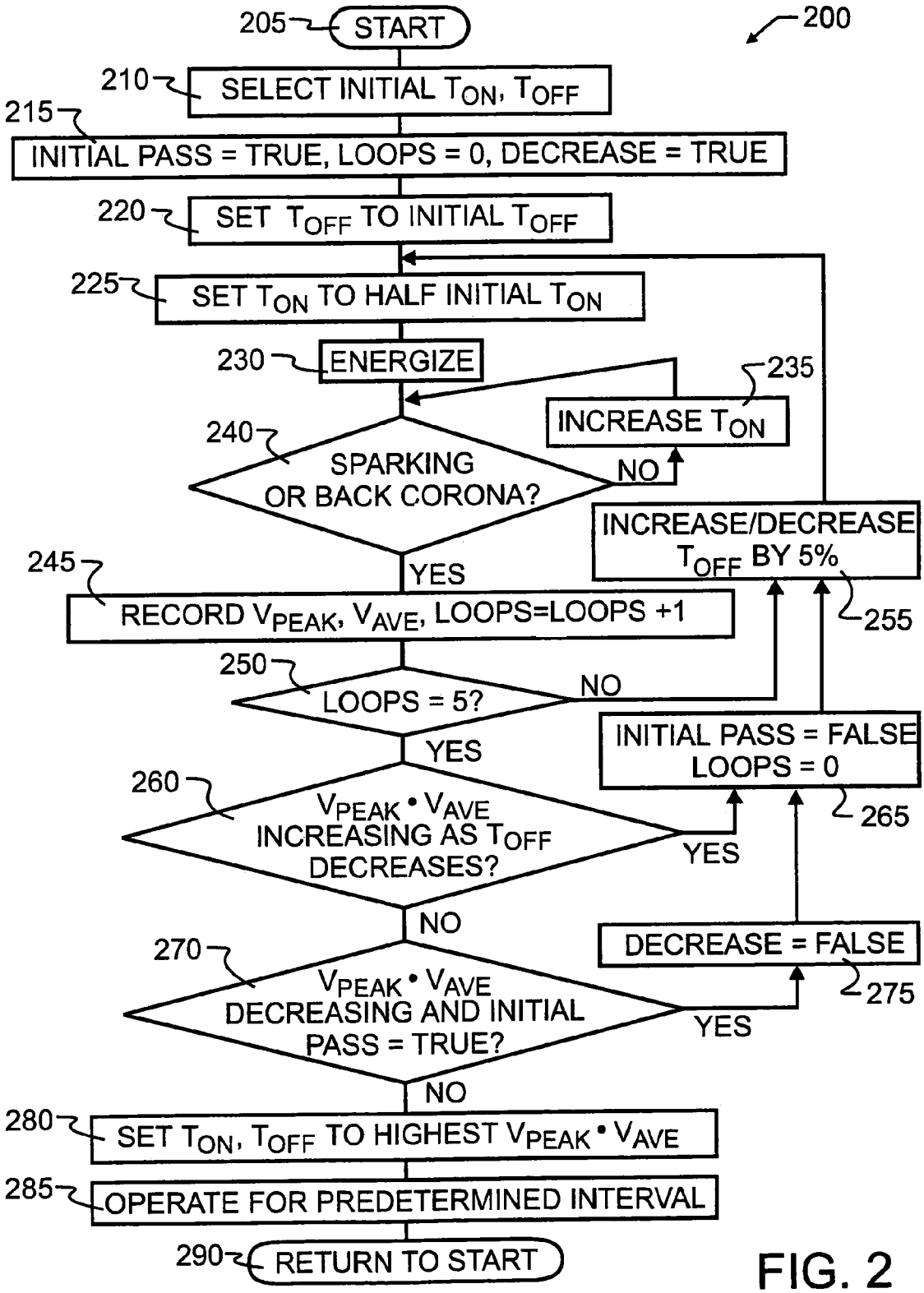
FIG. 2 illustrates a preferred method designed in accord with the teachings of the invention.

With reference to FIG. 2, a preferred ESP performance optimization control method 200 describes the steps used by control 140 to control the application of power from power supply 110 to electrostatic precipitator ESP. Step 205 designates a starting point for the beginning of a control cycle. While it may be the initial start-up of the electrostatic precipitator ESP, start 205 therefore does not have to be, and may alternatively be executed at any time during the operational sequence used therein. In other words, start 205 designates the beginning of only one cycle of preferred ESP performance optimization control method 200, and this cycle may be initiated at some indeterminate time during the operation of electrostatic precipitator ESP. Most preferably, the cycles will be initiated at the beginning of operation and may be initiated periodically thereafter. This is represented in FIG. 3 by waveform 300 at point 305, where the voltage sensed by sensor 130 begins at the zero voltage line, and increases in magnitude.

At step 207, the corona onset voltage is determined. In the preferred embodiment, this may, for exemplary purposes but not limited thereto, be achieved by slowly ramping up the high voltage applied to electrostatic precipitator ESP. As the voltage is ramping up, flow of current through electrostatic precipitator ESP may be monitored, and at some predetermined flow of current, the corona onset will be determined. The corona onset voltage may then be stored and saved for later use. This is represented in FIG. 3 by waveform 300 at point 310, which designates the intersection of waveform 300 with a voltage magnitude great enough to begin the onset of corona. Corona onset is defined as the lowest voltage that produces a measurably significant current in the precipitator. By measurably significant, it is understood that this is the voltage at which electrons begin to measurably charge particulates in the gas stream, as opposed to minor or inconsequential leakage currents and the like that might otherwise exist. This corona onset voltage is generally detectable by a relatively sudden increase in current flowing through electrostatic precipitator ESP, as a result of the transfer of charge from precipitator electrodes to particulate and then to collector plate. The corona onset voltage is illustrated in FIG. 3 as a horizontal line offset in magnitude from the zero potential line.

Next, the spark voltage will be determined at step 208. In the preferred embodiment, this may, for exemplary purposes but not limited thereto, be achieved by setting power supply 110 to a maximum available duty cycle, which will lead in turn to the most rapid increase in voltage across electrostatic precipitator ESP possible. While the voltage is increasing, electrostatic precipitator ESP should be monitored for an arc, spark or the limiting voltage. The limiting voltage will be understood to be system dependent, but may the peak voltage permitted by electrostatic precipitator ESP, or may be the peak voltage from power supply 110, or other voltage limit required by any of the system components for safe operation. When the arc, spark or limiting voltage is reached, this value may be saved as Vsp, Vspt, and any arcing will be quenched using standard arc quenching techniques.

Figure 3:
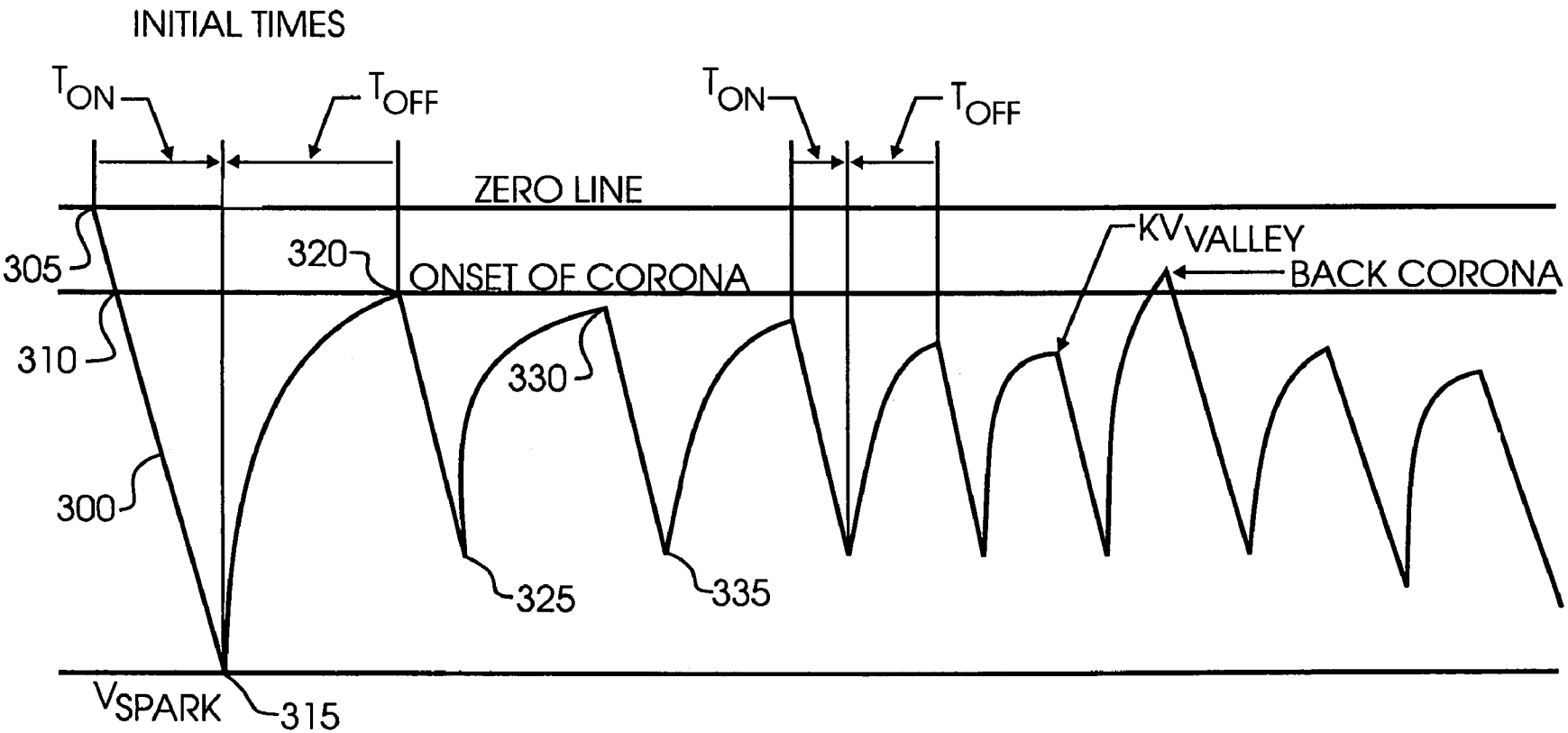
FIG. 3 illustrates a preferred waveform illustrating an exemplary application of the features of the invention.

With reference to FIG. 3, point 315 of waveform 300 designates the voltage applied across electrostatic precipitator ESP having risen in magnitude to a value which is sufficient to initiate a spark between the precipitator electrodes and collector plates, shown in FIG. 3 by horizontal line designated Vspark. It will be understood by those skilled in the art that the corona onset voltage and the voltage required to initiate a spark are both dependent to some extent upon the characteristics of the gas stream, including level and type of particulate and other contaminant, composition of gasses in the stream, physical geometry of electrostatic precipitator ESP, and other factors that will be apparent to those skilled in the art. Consequently, these voltages may not actually be represented by horizontal lines in a real system, and may vary in magnitude with the changing system parameters. Consequently, in the preferred embodiment, power supply 110 may be used to energize electrostatic precipitator ESP and the current there through sensed to detect the onset of corona. This magnitude will be determined to be the value for point 310. When a spark discharge is detected, or conditions are indicative of the eminence thereof, power supply 110 will then be disconnected from electrostatic precipitator ESP, and the magnitude for Vspark determined. At the time of disconnection, there will be some decay in voltage, represented graphically by point 317 in FIG. 3.

At step 210, the initial value for TOFF is selected. This selection process may preferably involve the application of power from power supply 110 to electrostatic precipitator ESP to bring the voltage to some predetermined percentage of the spark voltage VSP, represented by point 318 in FIG. 3. Typically, the voltage at point 318 will range between eighty and ninety-five percent of spark voltage VSP. Next, the duty cycle of power supply 110 may be reduced to zero, thereby eliminating the application of power to electrostatic precipitator ESP. The voltage will then decay until it either reaches the corona voltage VCO, established in step 207, or the off time equals some predetermined maximum off time. This time is illustrated in FIG. 3 as the time between points 318 and 320.

The values for TOFF, kVv, which is the voltage at the end of TOFF, and the calculated average voltage of this single TON-TOFF cycle, kVDC1-AVG, are now preferably stored at step 215. These values will also preferably be saved as previous values for each of the three foregoing variables as well.

Next, at step 220, the time required for voltage transition from point 320, the voltage at the end of TOFF, and the voltage level at point 318, which as aforementioned is some fraction of the onset of corona, represented as point 325, is determined and used as the initial value for TON. Most preferably this initial on time is calculated by applying continuous voltage, or maximum duty cycle, from power supply 10, and is not the result of a reduced duty cycle or the like. The initial off time TOFF is preferably calculated by disconnecting power supply 110 from electrostatic precipitator ESP and thereby allowing the voltage shown by waveform 300 to drift back down to the magnitude where the onset of corona is reached. From waveform 300, this is the time between points 318 and 320. While the preferred methods of calculating initial values for TON and TOFF are outlined herein above, those skilled in the art upon a reading of the present disclosure will recognize that other techniques may be used, including as an extreme example, random assignments of values, and the present method will still function. Nevertheless, the time required for the system to establish correct operating parameters may be increased by starting with less accurate initial values for TON and TOFF. In the preferred embodiment, when applied to the case of a coal-fired power plant, the initial on time may for exemplary purposes be approximately two milliseconds, and the initial off time may for exemplary purposes be approximately 20 milliseconds. While these times will vary based upon the actual equipment to which the present method is being applied, the aforementioned values are provided to present a relative proportion to later values, such as the predetermined time interval discussed in step 265 herein below.

Step 225 sets the present value for TOFF to some fraction of the initial value of TOFF, typically between ninety and ninety-nine percent. The voltage is not applied to electrostatic precipitator ESP during this time period set be the present value for TOFF.

At the completion of the present TOFF, at step 230, the values for TOFF, kVv, and kVDC1 are now preferably stored. Averages for these values will also preferably be calculated and stored. From the graph of FIG. 3, the first energization after determining initial times using the present TON will occur on waveform 300 between point 330 and point 335. The first TOFF will be from point 325 to point 330 on waveform 300.

In step 235, the Loops counter is checked to see how many loops have been completed. In the preferred embodiment there will be five loops, with each successive loop decreasing the TOFF interval by an amount typically in the range between one and ten percent. The number of loops and amount of decrease of TOFF is a matter of design choice, and the five loops and percent decrease illustrated herein are only exemplary and preferred for the particular hardware and desired optimization times and accuracy selected for the preferred embodiment. As already stated, if there have not yet been five loops, control proceeds to step 220, where TON is determined, and in step 225 TOFF is decreased. As mentioned, in the preferred embodiment, the loop will be repeated a total of five times before control will proceed to step 240.

At step 240, a determination is made as to whether TOFF-AVG is less than or equal to TON-AVG. If not, the values for TON and TOFF will preferably be held, and at step 245 a message will preferably be displayed to advise a human operator to use the DC mode.

At step 250, a determination is made whether kVv is increasing as TOFF is decreased. The preferred amount of increase will typically fall in the range of one to twenty-five percent. If not, a check is made at step 255 to determine whether kVDC1 is increasing as TOFF is decreased. The preferred amount of increase will typically fall in the range of one to twenty-five percent. If neither kVv nor kVDC1 is increasing sufficiently, flow returns through step 260 to step 215, for generation of new values for TON and TOFF.

If either steps 250 or 255 yield a positive result, then electrostatic precipitator ESP may be operated for a time interval at step 265. In the preferred embodiment, this time interval is predetermined and fixed, though any known technique to determine when self-testing is required or appropriate may be used. The operation of electrostatic precipitator ESP will occur using the determined values for TON and TOFF that optimize kVv and kVDC1-AVG, and which regulate the output to a particular suspended particulate matter requirement, using normal spark and arc routines as required. In the most preferred embodiment, the aforementioned steps of optimization will not simply be executed once, but will periodically be re-executed. This will ensure longer term operational efficiency, regardless of changes in parameters that might otherwise alter the performance of electrostatic precipitator ESP, such as varying particulate or gas content within the gas stream, or accumulation of particulate layer upon collector electrodes. Consequently, in the most preferred embodiment, at step 265 the TON and TOFF parameters are used to operate switch 120 for a predetermined time interval. In the preferred embodiment, when applied to the case of a coal-fired power plant, the predetermined interval may be approximately ten minutes.

When a predetermined time interval has elapsed, or other event that is used to indicate a desire to evaluate the system operation, flow will continue to steps 270, 275, and 280, which represent three different tests of the system to determine whether full re-tuning is required. The first of these at step 270 is to test spark voltage to see whether there is a decreased spark potential. This may, for exemplary purposes but not limited thereto, be achieved by setting power supply 110 to the maximum available duty cycle, and thereby increasing the voltage at electrostatic precipitator ESP to the level previously set at point 318, which is some fraction of the previously determined spark voltage. If sparking occurs, this will be an indication that the system needs re-tuned, and flow will return to step 208. Even if no sparking occurs, in the preferred embodiment, the voltage will be cycled back down for one TOFF cycle and again ramped up. This will be repeated in the preferred embodiment a total of five times to ensure that any transient effects are minimized.

Presuming there has been no detected decrease in the spark voltage VSP, the voltage at the end of TOFF, kVv, and the calculated average voltage of this single TON-TOFF cycle, kVDC1, are both checked to make sure they are within a suitable range. In the preferred embodiment, this range will typically be between about eighty and one-hundred twenty-five percent of the averages calculated for these values at step 230. If both are within acceptable range, flow continues at step 265, where operation will continue without additional performance tuning. If any of the values for steps 270, 275, 280 are out of range, flow will return to step 208 to initiate re-tuning of operation.

As should now be apparent, in spite of the numbers of steps of the preferred embodiment, the amount of time required for optimization is quite minimal with proportion to the operational time using these optimized parameters. In other words, the initial TON and TOFF cycle time is, in the preferred embodiment applied to a coal fired plant, only 22 milliseconds. Consequently, even with many loops required to determine optimization, well less than one second would be required for the present method to operate from step 205 to step 265. The optimal parameters are then used in the preferred embodiment environment for ten minutes. Clearly, the present method provides minimal disruption of operation, and ensures optimal performance for a vast percentage of operation time.

In a contemplated alternative to the foregoing automatic tuning, manual tuning may be provided as either an alternative choice or instead of automatic tuning. For manual tuning, an operator panel will be provided to select desired values for TON and TOFF. The kVv, kVDC1, and scalar product there between will preferably be displayed, to permit the operator to manually adjust TON and TOFF to maximize the scalar product of kVv and kVDC1. In this manual tuning system, default values for TON and TOFF may also preferably be loaded at the time of system initialization.

Figure 4:
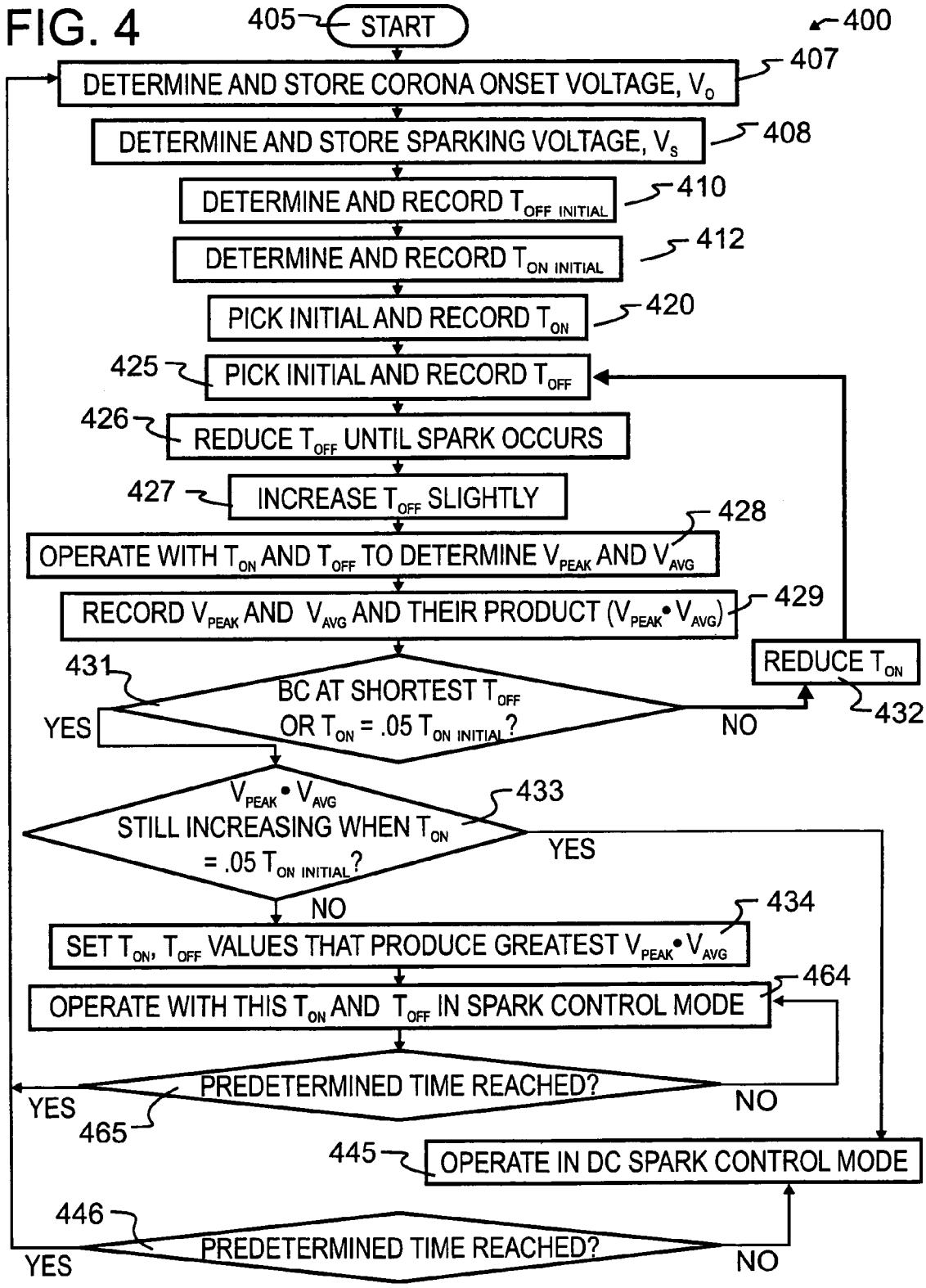
FIG. 4 illustrates an alternate method designed in accordance with the teachings of the invention.

A second exemplary embodiment ESP performance optimization control method 400 designed in accord with the teachings of the present invention is illustrated by flow chart in FIG. 4. Where actions similar to those of FIG. 2 are referenced, the second and third digits have been used to indicate such similarity. This method 400, like that of FIG. 2, describes the steps used by control 140 to control the application of power from power supply 110 to electrostatic precipitator ESP. As with method 200, a start 405 designates a starting point which may be at initial system start-up, or at any indeterminate time thereafter. Once started, the corona onset voltage $V_O$ and the spark voltage $V_{SPARK}$ are determined and stored, in steps 407 and 408 respectively. The initial off and on cycle times, $T_{OFF\ INITIAL}$ and $T_{ON\ INITIAL}$ are then determined and recorded in steps 410 and 412, and a $T_{ON}$ and $T_{OFF}$ are selected in steps 420 and 425. Through this step 425, method 400 very much resembles that of method 200.

In step 426, and while the system is continuing to operate, the interval of time $T_{OFF}$ is reduced gradually, until such time as sparking occurs. In the event of a spark, the usual spark extinguishing techniques will be implemented. This progression to an actual spark or detectable back corona ensures that the full limits of the system under current conditions are tested and verified, rather than estimated. Subsequent to this determination, $T_{OFF}$ will be slightly increased, by an amount which will be selected at design time, or which may be adjusted during operation through manual intervention. Through this combination of steps 426 and 427, the minimum $T_{OFF}$ will be determined for a given $T_{ON}$, which is equivalent to an identification of the maximum $V_{AVG}$ for this given $T_{ON}$. Both $V_{PEAK}$ and $V_{AVG}$ can then be determined operationally in step 428, by continuing to operate the ESP using the minimum $T_{OFF}$ and given $T_{ON}$. These values for $V_{PEAK}$ and $V_{AVG}$ will then be recorded at step 429. For the purposes of this disclosure, it will be understood that recording may include any time of temporary or permanent storage of values, such as may occur with non-volatile media such as magnetic, optical or flash media, or even relatively temporary storage into volatile memory such as RAM or the like, or, to illustrate an extreme, even pen and paper. The particular method of storage will depend upon the requirements for longer term data storage, the desired speed of data acquisition and utilization, or even dictated by a desire for minimum cost and complexity or other conceivable factors too numerous to individually recite herein. Exemplary are requirements such as may be predicated by regulatory agencies, a desire for later review and analysis, or other need.

Longer on-times than $T_{ON\ INITIAL}$ are known to induce sparking. Consequently, and in the extreme, operational cycling of waveform 300 could extend fully between peaks at spark voltage and onset of back corona. This would not result in optimum performance of the ESP, however. Consequently, step 432 leads to a gradual decrease in the $T_{ON}$ time. As $T_{OFF}$ is decreased, waveform 300 will shift with both peaks and valleys moving closer to the spark voltage $V_{SPARK}$. Steps 425–432 will be repeated until such time as either back corona occurs even with the shortest $T_{OFF}$ the system is capable of, or when $T_{ON}$ is some predetermined fraction of $T_{ON\ INITIAL}$. In the preferred embodiment, for exemplary purposes only, this is selected to be five percent of $T_{ON\ INITIAL}$. As will be understood, other values may be chosen to optimize the design for a particular system and application. In the event back corona occurs even with the shortest $T_{OFF}$ the system is capable of, this would indicate that shorter on times would still only continue to leave the system in back corona, and so further reduction of on times at step 432 would be of no value.

It should now be understood that shorter $T_{OFF}$ and $T_{ON}$ times will result in a flatter waveform, more closely resembling that of a DC waveform. Consequently, at step 433, a determination is made as to whether the scalar product of peak and average voltage is still increasing at the minimum on time reached. If this is the case, a DC operating voltage is indicated as the one that produces the greatest scalar product, and so operational flow will proceed to step 445, and the system will be operated in a DC spark control mode for a predetermined time interval at step 445. When the time interval has passed, which may for exemplary purposes only, be on the order of a few minutes, then method 400 will be re-initiated at step 407.

If instead at decision step 433, some combination of on and off times was detected which maximized the scalar product of peak and average voltages, then $T_{OFF}$ and $T_{ON}$ will be set to these values in step 434. The system will then be operated using these values in a spark control mode at step 464, until a predetermined time has been reached in step 465. Much like step 446, this time interval is set by designer or intervention during operation, but will be a reasonable amount of time for system operation before any tuning of operating parameters would likely offer benefit.

As will be readily appreciated by those skilled in the art, the essence of the concept inherent in the present invention is the achievement of optimum operation of the electrostatic precipitator by maximizing the scaler product of the peak voltage and the average voltage.

Two approaches or examples are as follows:

EXAMPLE 1

Intermittent Energization Self-Tuning Algorithm for Optimizing Peak Times Average in ESP Application Steps to Achieving Self-Tuning:

Please note that the program may run each of the following steps multiple times (loop through numerous times) and use an average value (for any given step) to minimize the possibility of improper self-tuning due to sporadic operation of the esp.

1. On initial turn-on of the high voltage, establish the voltage at which corona onset starts ($V_{co}$) and the voltage at which spark-over of the esp field occurs ($V_{sp}$). If no spark occurs, the voltage limit level becomes $V_{sp}$.
2. The next step is to establish the value require for $T_{off}$. This is done by
   - 2.1 Ramping the voltage to K2*$V_{sp}$ (where K2 is 80 to 95%) and letting the voltage decay until it reaches $V_{co}$. The value of $T_{off}$ at this point becomes $T_{off_initial}$.
   - 2.2 The voltage is then turned back on again until K2*$V_{sp}$ is reached; this time the voltage is allowed to decay for $T_{off}$=K3*$T_{off_initial}$ (where K3=0.8 to 0.95).
   - 2.3 Each cycle consisting of a period of $T_{on}$ plus $T_{off}$, the cycle average and the minimum voltage (kV_valley) are compared to the previous cycle.
   - 2.4 If the valley drops below K4*kV_valley or the average drops below K5*kV_average (K4 and K5 range 0.8 to 0.99), then there is indication of back corona and $T_{off}$ is increased by a factor of K6 (typical range 1.01 to 1.025). The controller is now operating close to optimum $T_{off}$ and the operating value of $T_{off}$ has been established.
   - 2.5 If The kV_valley and kV_average continue to rise as K2*$V_{sp}$ is held constant and $T_{off}$ is decreased, then the controller repeats step 2.2 until the test of step 2.4 indicates the onset of back corona or until $T_{off}$ gets so small that operation in DC mode is preferred.
3. Once $T_{off}$ is established, the controller starts increasing $T_{on}$ by a multiplier of K8 where K8 ranges 1.01 to 1.25. This will bring the controller back into the operating situation where sparking of the esp electrodes occur. Since $V_{sp}$ is the highest voltage that can be obtained without breakover and $T_{off}$ is optimized to the shortest value it can be without entering into back corona, the value of kV peak (i.e. $V_{sp}$) times kVdc_average (shortest $T_{off}$) is maximized.

3.1 The controller monitors kV_peak, kV_average, and kV_valley as it ramps from the self-tune operating point to the region of esp sparking. If, during this time period, the kV_valley and/or the kV_average start to drop as kV_peak continues to rise, $T_{off}$ is increased by a multiplier of K6 to further optimize the $T_{off}$ time period as the operating point near sparking voltage is approached.

3.2 The gradual increase of $T_{on}$ while only changing $T_{off}$ slightly, if at all, is how the controller continues to raise the peak and average voltages to seek the sparking level and to regulate the output to achieve the spark per minute setting (SPM) entered by the user.

3.3 The rate at which $T_{on}$ is increased determines the slow ramp of increasing voltage that is used to regulate to a SPM setting.

4. When the esp electrodes are to ground, the controller senses this condition by monitoring the kV feedback signal at a very fast sampling rate.

4.1 The output from the IGBT inverter is turned off for a Quench period of 1 to 20 milliseconds.

4.2 At the end of the Quench period, the inverter is turned full on until a setback voltage ($V_{sb}$) is reached that is determined by the inputs entered by the user.

4.3 The unit then turns off for a $T_{off}$ equal to the value of $T_{off}$ previous to the voltage breakover occurring.

4.4 When $T_{off}$ has timed out, the inverter turns on for $T_{on}$ equal to $T_{on}$ (previous to the breakover) times $V_{sb}$ divided by $V_{sp}$.

4.5 The controller then increases $T_{on}$ as described in steps 3.2 and 3.3.

5. Periodically, the controller needs to retune to make sure it is operating at the proper levels as described above. There is a quick tune and a full tune mode:

5.1 If the average value is $V_{sp}$ remains within a ±10% window over a 10 minute period, then a quick tune is initiated. This is accomplished by operating the controller at a point equivalent to that of step 2.4. If the values for kV average and kV_valley agree within an arbitrary X % of the earlier readings, the unit is still in tune and operation resumes.

5.2 If the quick tune test is outside the windows of allowed change in $V_{sp}$ or differs more than X % from the earlier tuning values, then a full tune is implemented starting with step 1.

EXAMPLE 2

Peak Times Average Algorithms

1. Determine corona onset voltage, sparking voltage, and the time ($T_{on\ initial}$) to go from corona onset to sparking voltage with full power on and the time ($T_{off\ initial}$) to drift from just below sparking voltage to corona onset voltage. Go to step 2.
2. Pick initial $T_{on}$, which is slightly less than $T_{on\ initial}$ (say 0.95 $T_{on\ initial}$). Go to step 3.
3. Pick initial $T_{off}$ (say $T_{off\ initial}$). Go to step 4.
4. Starting with this $T_{on}$ and $T_{off}$ keeping reducing $T_{off}$ until sparking occurs. Go to step 5.
5. Increase $T_{off}$ slightly (say $T_{off}$=1.05 $T_{off}$ at spark). Go to step 6.
6. Operate long enough with this $T_{on}$ and $T_{off}$ to determine $V_{pk}$ and $V_{average}$ and record these numbers and their product. Go to step 7.
7. Decrease $T_{on}$ slightly (say by 5%). Go to step 8.
8. Repeat steps 3 through 7 until $T_{ON}$=0.05 $T_{ON\ INITIAL}$ or until back corona occurs for the shortest $T_{OFF}$. When $T_{ON}$=0.05 $T_{ON\ INITIAL}$ or when back corona occurs for the shortest $T_{OFF}$, go to step 9.
9. If the product of $V_{pk}$ and $V_{average}$ is still increasing when $T_{on}$=0.05 $T_{on\ initial}$, operate in the DC mode, and go to step 11; otherwise go to step 10.
10. Pick $T_{on}$ and $T_{off}$ from these sets that produces the highest product of $V_{pk}$ and $V_{average}$ and operate with $T_{on}$ and $T_{off}$ at the values that maximize the product of $V_{pk}$ and $V_{average}$. Go to step 11.
11. Operate for a predetermined time (say 5 minutes), in the spark rate control mode with the $T_{on}$ and $T_{off}$ chosen in step 9 or step 10. At the end of the predetermined time, go back to step 1.

Having thus disclosed the preferred embodiment and some alternatives to the preferred embodiment, additional possibilities and applications will become apparent to those skilled in the art without undue effort or experimentation. From the present teachings, other iterative processes will be apparent that could be used to identify the on and off times that maximize the product of the peak and average voltages. It will also be apparent that the present teachings could be applied to conventional low frequency power supplies, provided that the electronic components needed to continuously determine the peak and average voltages of the waveforms are added to the apparatus, and recognizing the loss of benefits inherent in such a combination. Therefore, while the foregoing details what is felt to be the preferred embodiment of the invention, no material limitations to the scope of the claimed invention are intended. Further, features and design alternatives that would be obvious to one of ordinary skill in the art are considered to be incorporated herein. Consequently, rather than being limited strictly to the features recited with regard to the preferred embodiment, the scope of the invention is set forth and particularly described in the claims herein below.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A method of applying electrical energy to an electrostatic precipitator collector which optimizes precipitation of high resistivity particulates from a gas stream, comprising the steps of:

selecting an initial time interval for application of electrical energy having a first electrical polarity to said electrostatic precipitator collector and an initial time interval for interrupting said application of electrical energy;

determining optimum amounts of time for said application of electrical energy and said interrupting of said application based upon the greatest peak voltage magnitude applied and greatest average voltage magnitude applied; and collecting precipitate on said electrostatic precipitator collector using said optimum amounts of time for said application of electrical energy and said interrupting of said application.

2. The method of applying electrical energy to an electrostatic precipitator collector of claim 1, further comprising the steps of:

measuring a time interval of said collecting step;

re-establishing optimum amounts of time for said application of electrical energy and said interrupting of said application based upon the greatest peak voltage magnitude applied and greatest average voltage magnitude applied responsive to said measured time interval of said collecting step exceeding a threshold; and resetting said measured time interval.

3. The method of applying electrical energy to an electrostatic precipitator collector of claim 1, wherein said selecting step further comprises the steps of:

establishing an amount of time required for said high frequency direct current power supply to charge said electrostatic precipitator from an electrical potential magnitude representative of some fraction of an onset of corona to an electrical potential magnitude representative of some fraction of a spark; and setting said initial time interval for application of electrical energy equal to said established time.

4. The method of applying electrical energy to an electrostatic precipitator collector of claim 1, wherein said selecting step further comprises the steps of:

establishing an amount of time required for said electrostatic precipitator to discharge from an electrical potential magnitude representative of a spark to an electrical potential magnitude representative of an onset of corona; and setting said initial time interval for interrupting said application of electrical energy equal to said established time.

5. The method of applying electrical energy to an electrostatic precipitator collector of claim 1, wherein said determining step is performed iteratively.

6. The method of applying electrical energy to an electrostatic precipitator collector of claim 5, wherein said iterative determining step further comprises the steps of:

specifying an active time interval for interrupting said application of electrical energy to equal said initial time interval for interrupting said application of electrical energy;

assigning an active time interval for application of electrical energy to equal said initial time interval for application of electrical energy;

alternately energizing said electrostatic precipitator for said active time interval for application of electrical energy and de-energizing said electrostatic precipitator for said active time interval for interrupting said application and decreasing said active time interval for interrupting said application of electrical energy during each subsequent active time interval for interrupting said application of electrical energy; and storing peak and average values of an electrical potential attained at said electrostatic precipitator.

7. The method of applying electrical energy to an electrostatic precipitator collector of claim 6, wherein said iterative determining step further comprises the steps of:

decreasing said active time interval for interrupting said application; and repeating said steps of alternately energizing and storing.

8. An electrostatic precipitator performance optimization control method for optimizing the performance of an electrostatic precipitator using a high frequency direct current power supply and processing moderate to high resistivity particulate gas streams such as are produced during the combustion of low-sulfur coal in electric utility plants, comprising the steps of:

establishing an initial on time interval for applying energy from said high frequency direct current power supply to said electrostatic precipitator comparable to an amount of time required for said high frequency direct current power supply to charge said electrostatic precipitator from an electrical potential magnitude representative of an onset of corona to an electrical potential magnitude representative of a spark;

determining an initial off time interval for disconnecting energy from said high frequency direct current power supply to said electrostatic precipitator comparable to an amount of time required for said electrostatic precipitator to discharge from an electrical potential magnitude representative of a spark to an electrical potential magnitude representative of an onset of corona;

specifying an active off time interval to approximately equal said initial off time interval;

assigning an active on time interval to approximately equal to said initial on time interval;

alternately energizing said electrostatic precipitator for said active on time interval and de-energizing said electrostatic precipitator for said active off time interval and decreasing said active off time interval during each subsequent active on time energizing interval;

storing peak and average values of an electrical potential attained at said electrostatic precipitator;

decreasing said active off time interval;

repeating said steps of alternately energizing and storing;

setting said active on time interval and said active off time interval to a maximum of said peak and average values of said electrical potential attained at said electrostatic precipitator; and operating said electrostatic precipitator by alternately energizing said electrostatic precipitator for said active on time interval and de-energizing said electrostatic precipitator for said active off time interval.

9. The electrostatic precipitator performance optimization control method of claim 8 wherein said setting step further comprises applying values to said active on time interval and said active off time interval that were stored with a maximum of said peak and average values of said electrical potential stored in said storing step.

10. The electrostatic precipitator performance optimization control method of claim 8 wherein said setting step further comprises applying values to said active on time interval and said active off time interval that are calculated from maximums of said peak and average values of said electrical potential stored in said storing step.

11. The electrostatic precipitator performance optimization control method of claim 10 further comprising the steps of:

operating said electrostatic precipitator using said active on time interval and said active off time interval for a plurality of cycles;

testing at least one of said spark voltage, said peak value of said electrical potential, and said average value of said electrical potential.

12. The electrostatic precipitator performance optimization control method of claim 8 further comprising the steps of:

deciding whether the stored peak and average values of an electrical potential attained at said electrostatic precipitator increase as said active off time interval decreases; and responsive to an affirmative decision in said deciding step:

decreasing said active off time interval; and re-executing said assigning, alternately energizing, storing, decreasing, repeating, and setting steps.

13. The electrostatic precipitator performance optimization control method of claim 8 further comprising the step of re-executing said establishing, determining, specifying, assigning, alternately energizing, storing, decreasing, repeating, setting and operating steps after a predetermined time of operation has elapsed.

* * * * *